United States Patent [19]

Rathert

[11] Patent Number: 4,507,036

[45] Date of Patent: Mar. 26, 1985

[54] INNER BOOK CLAMP

[75] Inventor: Horst Rathert, Minden, Fed. Rep. of Germany

[73] Assignee: Rahdener Maschinenfabrik August Kolbus, Rahden, Fed. Rep. of Germany

[21] Appl. No.: 466,048

[22] Filed: Feb. 14, 1983

[30] Foreign Application Priority Data

Feb. 27, 1982 [DE] Fed. Rep. of Germany ..... 3207102

[51] Int. Cl.[3] ..... B42C 13/00; B42C 5/00; B42B 9/00

[52] U.S. Cl. ..... 412/9; 412/8; 412/22

[58] Field of Search ..... 412/9, 10, 8, 22; 281/45; 403/DIG. 1

[56] References Cited

U.S. PATENT DOCUMENTS 2,163,812 6/1939 Schramm ..... 412/8

3,085,265 4/1963 Biel et al. ..... 412/9

FOREIGN PATENT DOCUMENTS 731159 12/1942 Fed. Rep. of Germany ..... 412/9

37457 10/1981 Fed. Rep. of Germany ..... 412/10

*Primary Examiner*—Paul A. Bell

*Assistant Examiner*—Paul M. Heyrana, Sr.

[57] ABSTRACT

An inner book clamp for clamping and conveying inner books in an inner book processing machine includes a pair of clamp jaws having parallel clamp plates, the jaws being movable together in a first direction and one of said jaws being movable in a second direction, transverse to the first direction, to vary the spacing therebetween. The movement in the transverse direction of the movable jaw permits adjustment of the clamping force to be applied to an inner book position between the jaws and the movable jaw will self-lock in the book engaging position in response to a force in the opening direction.

20 Claims, 3 Drawing Figures

INNER BOOK CLAMP

BACKGROUND OF THE INVENTION (1) Field of the Invention

The present invention relates to clamping mechanisms and particularly to such mechanisms for use in book manufacturing systems. More specifically, this invention is directed to the manufacture of books and especially to the conveying of inner books between work stations of an inner book processing machine. Accordingly, the general objects of the present invention are to provide novel and improved apparatus and methods of such character.

(2) Description of the Prior Art

In the manufacture of a book it is necessary to move the finished or semi-finished inner book between work stations. To this end, inner book processing machines having transport systems including inner book clamps with oppositely disposed clamp jaws, which may be guided along parallel paths, are known in the art. An example of such a prior inner book clamping mechanism may be seen from published German Patent Application No. 2,815,144. In the system of this published German Application one of the clamp jaws, referred to as the outer jaw, is movable horizontally and transversely to the direction of movement of the other or inner jaw. Thus, to achieve the requisite gripping and conveying, drive devices disposed on each side of the clamp are provided on both jaws. These drive devices are in the form of racks and pinions which carry a frame provided with a cam follower. The clamping force for holding the inner book is derived from a pair of springs which are compressed as a result of the movement of the cam roller along a control cam.

Continuing to discuss prior art devices of the type exemplified by German Application No. 2,815,144, a coupling device installed on the clamp plate of the inner clamp jaw is used to hold the clamp device in both the open and closed positions. Devices of the type shown in German Application No. 2,815,144 are comparatively expensive to manufacture as a result of the relatively complicated drive devices employed to impart movement to the outer clamp jaw, the need for the above-mentioned coupling devices and the requirement for a relatively heavy construction. Further, because of the linear characteristics of the clamping force producing springs, the clamping force decreases as the thickness of the inner book being transported decreases. Thus, to insure that the requisite clamping force will be obtained regardless of inner book thickness, the clamp device must be "over-engineered", i.e., must employ relatively large springs and associated force transmission elements.

A further example of a device for clamping and conveying inner books may be seen from published German Application No. 2,110,836. In the system of this application the clamp jaws are guided along parallel paths and the outer clamp jaw supports racks which are displaceable along the longitudinal axis of the inner clamp jaw. These racks engage pinions at the end of a shaft mounted from the inner clamp jaw, this shaft being parallel to the outer jaw. The racks are joined together behind the inner clamp jaw by means of a bow which causes the opening and closing movement of the jaws by cooperation with a cam roller. In the device of published German Application No. 2,110,836 the clamping force is derived from a torsion spring mounted on the shaft which carries the pinions. The torsion spring extends between the shaft and the inner clamp jaw and the degree of tension in the spring is a function of the distance between the clamp jaws. In order to hold the clamp device in the open position, a return locking device in the form of a second coil spring disposed on the pinion gear shaft is employed.

Inner book clamping devices of the type shown in published German Application No. 2,110,836 have the same disadvantages as discussed above with respect to the device of German Application No. 2,815,144.

To summarize the state of the art, it has not previously been possible to easily vary the clamping force of an inner book clamping device to compensate for the thickness of the inner book to be transported. The previous inability to vary clamping force is particularly significant when the book is comprised of certain types of paper, for example smooth paper. The inability to vary clamping force has resulted in thin inner books being gripped with a substantially reduced clamping force when compared to comparatively thick inner books.

SUMMARY OF THE INVENTION

The present overcomes the above-briefly discussed and other deficiencies and disadvantages of the prior art by providing a clamp which is particularly well-suited for use in a transport mechanism for conveying inner book and which is of substantially less complex construction, less expensive and has a lower weight when compared to prior art devices of similar character. Further, an inner book clamp in accordance with the present invention is adjustable such that a desired clamping force, independent of the thickness of the inner book, may be applied to an inner book to be transported. The present invention also contemplates a method for the conveying of inner books between work stations with a clamping force which may be varied as desired.

In apparatus in accordance with the invention the outer clamp jaw, i.e., the jaw which is movable both parallel with and transverse to the inner clamp jaw, is mounted on a guide device for free sliding both toward and away from the inner jaw. The apparatus also encompasses means for locking the outer jaw on the guide device in response to an outwardly acting force of a predetermined magnitude.

In accordance with the preferred embodiment, the locking means comprises a self-locking mechanism including an eccentric member.

Also in accordance with the preferred embodiment the outer clamp jaw is provided with a clamp plate which, by means of a slide guide, is mounted from the guide device, the guide device comprising a shaft which extends from the inner clamp jaw. The clamp plate of the outer clamp jaw and the slide guide are coupled together by a parallel link arrangement.

A compression spring, which produces the clamping force, will preferably be disposed between the clamp plate of the outer clamp jaw and the parallel link coupling arrangement.

The self-locking means employed in the preferred embodiment is mounted on the slide guide and contains an eccentric which, by means of a spring member, is caused to bear against the guide shaft which extends from the inner clamp jaw. A lever extends from the eccentric and secures the same against rotation. The locking means may be unlocked by actuating the lever against the action of the spring member.

It is also desirable, in accordance with the invention, to employ a cam arrangement to unlock the locking means. To this end, a roller may be provided on the locking means, particularly on the lever which extends from the eccentric, and this control roller will cooperate with an opening cam positioned at the appropriate point along the path of movement of the clamp device. The closing of the clamp device jaws, i.e., the movement of the outer jaw toward the inner jaw, is also preferably accomplished by cooperation between a roller mounted at an appropriate point on the outer clamp jaw assembly and a suitably positioned closing cam. The location of the opening and closing cams is adjustable so as to allow a variation of clamping force.

A further feature of an inner book clamp device in accordance with the present invention resides in the provision, in the region which will be juxtapositioned to the head of the inner book which is to be clamped, of a resilent portion of the clamp plate of the inner clamp jaw.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

Figure 2:
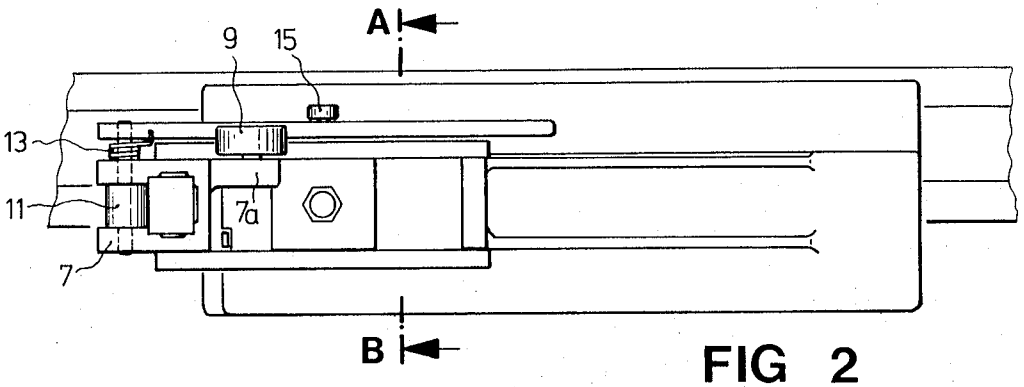
FIG. 2 is a front view of the apparatus of FIG. 1.
Figure 1:
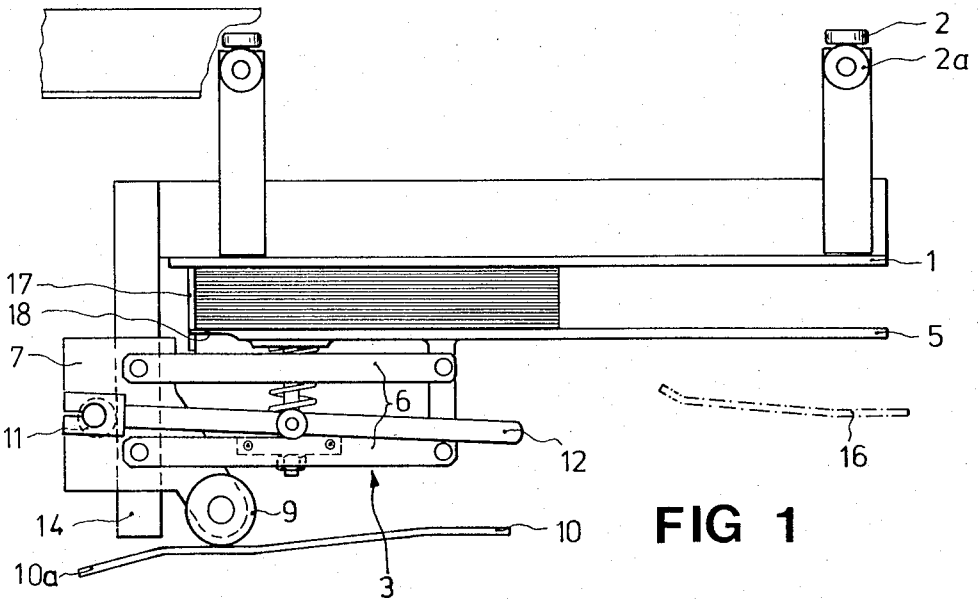
FIG. 1 is a plan view of an inner book clamp in accordance with one embodiment of the present invention.
Figure 3:
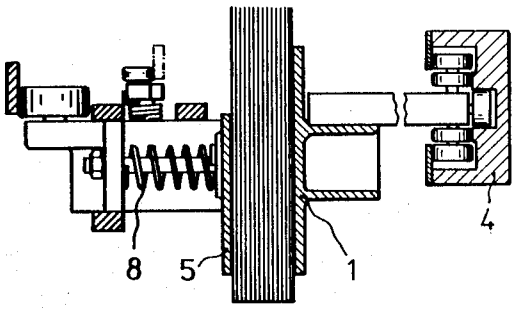
FIG. 3 is a cross-sectional view taken along line A–B of FIG. 2.

With reference now to the drawing, the disclosed inner book clamp will be incorporated in a conveying system which comprises a multiplicity of such clamps disposed at equal distances from one another and movable continuously along a closed path. The conveying system will, in turn, form a part of an inner book processing machine having plural work stations to which inner books must be conveyed. The closed path along which the inner book clamps move is defined by a guideway 4 along which horizontal and vertical guide rollers 2 and **2*a* move. These guide rollers are affixed to the ends of arms which extend, in a generally transverse direction, from an inner jaw 1 of the clamp. Inner jaw 1 cooperates with an outer clamp jaw which has been indicated generally at 3. The outer clamp jaw 3 includes a clamping plate 5 which is oriented substantially parallelly with respect to jaw 1 and which, in the manner to be described below, moves both with jaw 1** in the direction of book transport and transversely with respect thereto.

A guide rod 14 is affixed to and extends transversely, in the direction of outer jaw 3, from the inner jaw 1. The outer jaw 3 is mounted for free-sliding movement on guide rod 14. This free-sliding movement is permitted by a slide guide 7 which loosely engages rod 14. The clamp plate 5 is coupled to slide guide 7 by means of a parallel linkage arrangement which has been indicated at 6. A compression spring 8 is disposed between the outwardly facing side of plate 5 and linkage 6 as shown. The clamping force, which will be applied to an inner book positioned between jaw 1 and plate 5, will be a function of the deflection of spring 8 and will vary from a preselected initial force to a maximum force.

A cam follower 9 is provided on an arm **7*a* which extends from slide guide 7 of the outer clamp jaw 3. Cam follower 9 will engage a "closing" cam 10 which is installed at the appropriate point along the path of movement of the clamp device as defined by guideway 4. The pressure force applied to the outer clamp jaw 3 thus originates from the closing cam 10**.

The distance between closing cam 10, which is provided with an entry region **10*a*, and the inner clamp jaw 1** may be adjusted, by means not shown, in accordance with the thickness of the inner book or the magnitude of the clamping force it is desired to apply to the inner book.

In order to maintain the clamping force provided by spring 8 as a consequence of the compression thereof resulting from the cooperation between cam follower 9 and closing cam 10, when cam follower 9 clears cam 10, a self-locking mechanism is provided on the slide guide 7. This self-locking mechanism comprises an eccentric 11 rotatably mounted in slide guide 7 on a shaft as may best be seen from FIG. 2. A lever 12 is affixed to the end of the mounting shaft for eccentric 11 and a spring 13 is positioned between lever 12 and a surface of slide guide 7. The spring 13 rotatably biases the eccentric against guide rod 14 and, on movement of the outer clamp jaw 3 toward inner clamp 1 causes a slight retarding friction. When an outwardly acting force of sufficient magnitude is applied to the outer clamp jaw, the eccentric 11 will be locked against guide rod 14 by its self-locking action.

The locking mechanism is released, to able the outer clamp jaw 3 to again slide freely on guide rod 14, by actuating lever 12 in the outward direction. This may be done either by hand or automatically by means of an opening cam 16. The opening cam 16, if employed, will be located at a point along the closed path of the clamp where the inner book is to be released. The opening cam 16, if employed, will cooperate with a cam follower roller 15 mounted on lever 12. As in the case of the closing cam 10, the positioning of the opening cam 12 may be adjusted as a function of the thickness of the inner books being transported.

An inner book stop 17 is provided for the purpose of aligning the rear edge of the inner book in the clamp.

In order to obtain uniform pressure on the inner book over the entire length of the clamp, the outer clamp jaw 3 is provided, in the region which will be juxtapositioned to the head of the inner book which is to be clamped, with a resilent portion 18. This resilent portion permits the outer clamp jaw plate 5 to yield in the head region of the inner book, the head region often being thicker than the remainder of the inner book.

As should now be obvious to those skilled in the art, an inner book clamp in accordance with the present invention is distinguished by uncomplicated and comparatively light-weight construction, the foregoing being possible since the elaborate drive members for the movement of the outer clamp jaw which have characterized prior art devices have been eliminated. This uncomplicated construction is also permitted by the mounting of the outer clamp jaw at only one end thereof. Thus, an inner book clamp in accordance with the present invention may be inexpensively manufactured and, in addition, is of lighter weight whereby the entire inner book processing machine with which the clamps are employed may be of simplified construction.

A particular unique feature of the present invention resides in the ability to adjust the pressure applied to the inner book by moving the closing cam 10 toward and away from the inner jaw 1. Accordingly, adequate pressure is always available irrespective of the thickness of the inner books being transported.

A unique operational feature of the present invention resides in the fact that the closing or clamping force is applied over an extremely short path, i.e., a minimum of clamping work is required. This factor also contributes to reducing the cost of manufacture and operation of the apparatus by minimizing the power required to open and close the outer clamp jaw.

It is also noteworthy that, as a result of the fact that the outer clamp jaw is supported adjacent only one end thereof, that the most favorable conditions for insertion of an inner book between the jaws is obtained.

It is to be understood that the invention is not limited to the illustration described and shown herein, which is deemed to be merely illustrative of the best mode of carrying out the invention, and which is susceptible to modification of form, size, arrangement of parts and details of operation. The invention rather is intended to encompass all such modifications which are within its spirit and scope as defined by the claims.

What is claimed is:

1. In a book manufacturing system, the system having continuously operable conveying means for transporting partially completed books between work stations, the conveying means including plural spaced apart clamps, an improved clamp comprising:

inner clamp jaw means, said inner clamp jaw means including a clamp plate;

means for imparting motion in a first direction along a predetermined path to said inner jaw means;

outer clamp jaw means, said outer jaw means including a clamp plate;

means for coupling said outer jaw means to said inner jaw means whereby said outer jaw means will move in said first direction with said inner jaw means, said coupling means permitting said outer jaw means to move along an axis which is generally transverse to said first direction to thereby vary the spacing between said clamp jaw means clamp plates;

means for imparting motion to said coupling means whereby said outer clamp jaw means clamp plate may be caused to move along said axis in the closing direction generally toward said inner clamp jaw means clamp plate;

self-locking means for fixing the spacing between said jaw means clamp plates in response to a force in the opening direction on said outer jaw means; and unlocking means, said unlocking means cooperating with said self-locking means to permit movement of said outer jaw means clamp plate in the opening direction.

2. The apparatus of claim 1 wherein said coupling means comprises:

guide means, said guide means being affixed to and extending generally in said second direction from said inner jaw means;

slide means, said slide means being mounted for movement on said guide means and carrying said self-locking means; and means connecting said slide means to said outer jaw means clamp plate.

3. The apparatus of claim 2 wherein said self-locking means comprises an eccentric locking mechanism.

4. The apparatus of claim 2 wherein said means for connecting said slide means to said outer jaw means plate comprises a parallel link arrangement.

5. The apparatus of claim 2 wherein said means for imparting motion to said coupling means in the closing direction comprises:

a first cam follower, said first cam follower being mounted on said slide means; and a closing cam, said closing cam being positionable to contact said first cam follower during movement of said jaw means in the first direction, said closing cam having a contour which will cause said outer jaw means to move toward said inner jaw means to a position where a preselected clamping force will be imparted to an inner book positioned between said jaw means.

6. The apparatus of claim 2 wherein said outer jaw means plate comprises a resilent portion adjacent a first edge thereof.

7. The apparatus of claim 3 wherein said means for connecting said slide means to said outer jaw means plate to said slide means comprises a parallel link arrangement.

8. The apparatus of claim 4 wherein said outer jaw means further comprises:

a compression spring for producing a clamping force, said compression spring being positioned between said outer jaw means plate and said parallel link arrangement.

9. The apparatus of claim 7 wherein said outer jaw means further comprises:

a compression spring for producing a clamping force, said compression spring being positioned between said outer jaw means plate and said parallel link arrangement.

10. The apparatus of claim 7 wherein said guide means comprises an elongated rod and wherein said eccentric locking mechanism comprises:

an eccentric member, said eccentric member being rotatably mounted in said slide means in abutting relationship to said guide means rod; and means for resiliently biasing said eccentric member against said guide means rod whereby relative movement between said slide means and said guide means rod as a result of movement of said outer jaw means clamp plate in the opening direction in response to an opening force on said outer jaw means will cause rotation of said eccentric means in a first direction of rotation to thereby lock said slide means against further movement on said guide means rod.

11. The apparatus of claim 9 wherein said guide means comprises an elongated rod and wherein said eccentric locking mechanism comprises:

an eccentric member, said eccentric member being rotatably mounted in said slide means in abutting relationship to said guide means rod; and means for resiliently biasing said eccentric member against said guide means rod whereby relative movement between said slide means and said guide means rod as a result of movement of said outer jaw means clamp plate in the opening direction in response to an opening force on said outer jaw means will cause rotation of said eccentric means in a first direction of rotation to thereby lock said slide means against further movement on said guide means rod.

12. The apparatus of claim 9 wherein said unlocking means comprises:

lever means, said lever means being connected to said eccentric member, actuation of said lever means imparting rotation to said eccentric means in a second direction of rotation opposite to said first direction of rotation to cause unlocking of said self-locking means.

13. The apparatus of claim 10 wherein said unlocking means comprises:

lever means, said lever means being connected to said eccentric member, actuation of said lever means imparting rotation to said eccentric means in a second direction of rotation opposite to said first direction of rotation to cause unlocking of said self-locking means.

14. The apparatus of claim 11 wherein said means for imparting motion to said coupling means in the closing direction comprises:

a first cam follower, said first cam follower being mounted on said slide means; and a closing cam, said closing cam being positionable to contact said first cam follower during movement of said jaw means in the first direction, said closing cam having a contour which will cause said outer jaw means to move toward said inner jaw means to a position where a preselected clamping force will be imparted to an inner book positioned between said jaw means.

15. The apparatus of claim 13 wherein said means for imparting motion to said coupling means in the closing direction comprises:

a first cam follower, said first cam follower being mounted on said slide means; and a closing cam, said closing cam being positionable to contact said first cam follower during movement of said jaw means in the first direction, said closing cam having a contour which will cause said outer jaw means to move toward said inner jaw means to a position where a preselected clamping force will be imparted to an inner book positioned between said jaw means.

16. An inner book clamp for clamping and conveying inner books in an inner book processing machine comprising:

inner clamp jaw means, said inner jaw means including a clamp plate;

means for imparting motion in a first direction along a predetermined path to said inner jaw means;

outer clamp jaw means, said outer jaw means including a clamp plate;

guide means, said guide means being affixed to said inner jaw means and including a guide rod extending from said inner jaw means in a second direction generally transverse to said first direction;

slide means, said slide means being mounted on said guide means for motion relative thereto in the opening and closing directions of the clamp;

means connecting said slide means to said outer jaw means clamp plate;

means for imparting motion to said outer clamp jaw means to cause said outer jaw means to move generally toward said inner clamp jaw means, said slide means moving relative to said guide means in the closing direction during movement of said outer clamp jaw means generally toward said inner clamp jaw means;

an eccentric locking member, said eccentric member being rotatably mounted in said slide means in abutting relationship to said guide means guide rod, rotation of said eccentric member in a locking direction in response to an opening force on said outer jaw means preventing further relative motion between said slide means and said guide means in the clamp opening direction thereby fixing the spacing between said jaw means clamp plates; and means for resiliently biasing said eccentric member against said guide means guide rod whereby relative movement between said slide means and said guide means guide rod in the clamp opening direction will cause rotation of said eccentric means in the locking direction.

17. The apparatus of claim 16 wherein said unlocking means comprises:

lever means, said lever means being connected to said eccentric member, actuation of said lever means imparting rotation to said eccentric means in a second direction of rotation opposite to said first direction of rotation to cause unlocking of said self-locking means.

18. The apparatus of claim 16 wherein said means for imparting motion to said outer clamp jaw means comprises:

a first cam follower, said first cam follower being mounted on said slide means; and a closing cam, said closing cam being positionable to contact said first cam follower during movement of said jaw means in the first direction, said closing cam having a contour which will cause said outer jaw means to move toward said inner jaw means to a position where a preselected clamping force will be imparted to an inner book positioned between said jaw means.

19. The apparatus of claim 17 wherein said unlocking means further comprises:

a second cam follower, said second cam follower being mounted on said lever means; and an opening cam, said opening cam being positionable along the path of movement of said jaw means so as to be engaged by said second cam follower whereby said lever means will be caused to rotate said eccentric means in said second direction of rotation.

20. The apparatus of claim 18 wherein said outer jaw means plate comprises a resilent portion adjacent a first edge thereof.

* * * * *